US010241430B2

(12) United States Patent
Kimura et al.

(10) Patent No.: US 10,241,430 B2
(45) Date of Patent: Mar. 26, 2019

(54) TONER, AND EXTERNAL ADDITIVE FOR TONER

(71) Applicant: CANON KABUSHIKI KAISHA, Tokyo (JP)

(72) Inventors: Sho Kimura, Kashiwa (JP); Shuhei Moribe, Mishima (JP); Takashi Matsui, Mishima (JP); Hiroyuki Tomono, Numazu (JP); Shotaro Nomura, Suntou-gun (JP); Atsuhiko Ohmori, Yokohama (JP); Takuya Mizuguchi, Suntou-gun (JP); Tatsuya Saeki, Suntou-gun (JP); Katsuhisa Yamazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/969,192

(22) Filed: May 2, 2018

(65) Prior Publication Data

US 2018/0329323 A1 Nov. 15, 2018

(30) Foreign Application Priority Data

May 10, 2017 (JP) ..... 2017-094209
Apr. 23, 2018 (JP) ..... 2018-082313

(51) Int. Cl.
*G03G 9/09* (2006.01)
*G03G 9/08* (2006.01)
(Continued)

(52) U.S. Cl.
CPC ..... *G03G 9/0825* (2013.01); *G03G 9/0833* (2013.01); *G03G 9/08755* (2013.01)

(58) Field of Classification Search
CPC ..... G03G 9/093; G03G 9/09314; G03G 9/09321; G03G 9/09371; G03G 9/08755;
(Continued)

(56) References Cited

U.S. PATENT DOCUMENTS 6,875,549 B2 4/2005 Yamazaki et al.
6,881,527 B2 4/2005 Moribe et al.
(Continued)

FOREIGN PATENT DOCUMENTS

JP 2004-212740 A1 7/2004
JP 2012-013776 A1 1/2012
(Continued)

OTHER PUBLICATIONS

Machine English language translation of JP 2013-083837, May 9, 2013.*
(Continued)

*Primary Examiner* — Hoa V Le
(74) *Attorney, Agent, or Firm* — Venable LLP

(57) ABSTRACT

A toner comprising: a toner particle containing a binder resin and a colorant; and an external additive, wherein the external additive is a composite particle having an organic substance and an organosilicon polymer coating layer on the surface of the organic substance, and when a curve for the variation (dE'/dT) in the storage elastic modulus E' of the toner with respect to temperature T [° C.] is obtained on the basis of a curve of the temperature T—the storage elastic modulus E' [Pa] of the toner, as determined by powder dynamic viscoelasticity measurements of the toner, the relative minimum value on the lowest temperature side between the onset temperature and 90° C. is $-1.35\times10^{8}$ or less.

4 Claims, 3 Drawing Sheets

(51) Int. Cl.
*G03G 9/083* (2006.01)
*G03G 9/087* (2006.01)

(58) Field of Classification Search
CPC ..... G03G 9/08773; G03G 9/09725; G03G 9/09328; G33G 9/09328
See application file for complete search history.

(56) References Cited

U.S. PATENT DOCUMENTS 7,267,919 B2 9/2007 Moribe et al.
7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,537,877 B2 5/2009 Yoshiba et al.
7,544,455 B2 6/2009 Yoshiba et al.
7,638,251 B2 12/2009 Yamazaki et al.
7,678,523 B2 3/2010 Hiroko et al.
7,700,254 B2 4/2010 Moribe et al.
7,740,998 B2 6/2010 Yamazaki et al.
7,842,446 B2 11/2010 Yanase et al.
7,855,042 B2 12/2010 Kobori et al.
7,897,316 B2 3/2011 Yamazaki et al.
7,923,190 B2 4/2011 Magome et al.
7,935,467 B2 5/2011 Dojo et al.
8,026,030 B2 9/2011 Moribe et al.
8,057,977 B2 11/2011 Moribe et al.
8,227,162 B2 7/2012 Sano et al.
8,426,091 B2 4/2013 Magome et al.
8,426,094 B2 4/2013 Magome et al.
8,501,377 B2 8/2013 Takabashi et al.
8,512,925 B2 8/2013 Moribe et al.
8,614,044 B2 12/2013 Matsui et al.
8,778,585 B2 7/2014 Matsui et al.
8,841,054 B2 9/2014 Dojo et al.
8,883,389 B2 11/2014 Matsui et al.
9,040,216 B2 5/2015 Fukudome et al.
9,097,997 B2 8/2015 Nomura et al.
9,097,998 B2 8/2015 Yamazaki et al.
9,116,448 B2 8/2015 Terauchi et al.
9,128,400 B2 9/2015 Takahashi et al.
9,134,637 B2 9/2015 Hotta et al.
9,141,012 B2 9/2015 Moribe et al.
9,152,065 B2 10/2015 Sano et al.
9,201,323 B2 12/2015 Nishikawa et al.
9,213,250 B2 12/2015 Nomura et al.
9,213,251 B2 12/2015 Ohmori et al.
9,217,943 B2 12/2015 Matsui et al.
9,239,528 B2 1/2016 Hasegawa et al.
9,250,548 B2 2/2016 Nomura et al.
9,261,804 B2 2/2016 Yamazaki et al.
9,261,806 B2 2/2016 Moribe et al.
9,285,697 B2 3/2016 Fukudome et al.
9,304,422 B2 4/2016 Matsui et al.
9,341,970 B2 5/2016 Yoshiba et al.
9,348,246 B2 5/2016 Magome et al.
9,354,545 B2 5/2016 Matsui et al.
9,442,416 B2 9/2016 Magome et al.
9,442,419 B2 9/2016 Wakabayashi et al.
9,470,993 B2 10/2016 Nishikawa et al.
9,575,425 B2 2/2017 Naka et al.
9,581,934 B2 2/2017 Ito et al.
9,588,450 B2 3/2017 Tsuda et al.
9,606,462 B2 3/2017 Nomura et al.
9,658,546 B2 5/2017 Tanaka et al.
9,715,188 B2 7/2017 Terauchi et al.
9,772,570 B2 9/2017 Tsuda et al.
9,829,818 B2 11/2017 Yoshiba et al.
9,857,707 B2 1/2018 Tsuda et al.
9,897,932 B2 2/2018 Hotta et al.
9,904,195 B2 2/2018 Matsui et al.
9,964,874 B2 5/2018 Suzumura et al.
9,971,263 B2 5/2018 Fukudome et al.
2004/0110076 A1 6/2004 Yamazaki et al.
2009/0197192 A1 8/2009 Hiroko et al.
2013/0252167 A1 9/2013 Moribe et al.
2013/0309603 A1 11/2013 Takahashi et al.
2015/0125790 A1 5/2015 Hotta et al.
2015/0185658 A1 7/2015 Wakabayashi et al.
2016/0139522 A1 5/2016 Yoshiba et al.
2016/0161874 A1 6/2016 Yamazaki et al.
2016/0179024 A1 6/2016 Nishikawa et al.
2016/0202624 A1 7/2016 Nishikawa et al.
2018/0004106 A1 1/2018 Matsui et al.
2018/0004108 A1 1/2018 Tsuda et al.
2018/0004109 A1 1/2018 Matsui et al.
2018/0074425 A1 3/2018 Mizuguchi et al.

FOREIGN PATENT DOCUMENTS

JP 2013-083837 * 5/2013 ..... G03G 9/08
JP 2015-007765 A1 1/2015
JP 2015-045859 A1 3/2015
JP 2016-130843 A1 7/2016

OTHER PUBLICATIONS

U.S. Appl. No. 15/840,404, Kosuke Fukudome, filed Dec. 13, 2017.
U.S. Appl. No. 15/843,137, Atsuhiki Ohmori, filed Dec. 15, 2017.

* cited by examiner

TONER, AND EXTERNAL ADDITIVE FOR TONER

BACKGROUND OF THE INVENTION

Field of the Invention

The present invention relates to a toner used in electrophotography methods, electrostatic recording methods, magnetic recording methods, and the like, and to an external additive for the toner.

In recent years, higher speeds and longer service lives have been expected of electrophotographic machines. Furthermore, expectations relating to energy savings are still high, and a variety of proposals have been made for achieving both excellent durability and low temperature fixing performance in toners.

For example, Japanese Patent Application Publication No. 2012-013776 discloses an invention in which a core/shell type composite microparticle, in which the surface of a resin microparticle is coated with silica, is used as an external additive.

In addition, Japanese Patent Application Publication No. 2015-007765 indicates that by adding a crystalline polyester to a toner base and increasing sharp melting performance, low temperature fixing performance is improved.

Furthermore, Japanese Patent Application Publication No. 2004-212740 proposes a toner having a crystalline polyester on the surface of a host particle.

Furthermore, Japanese Patent Application Publication No. 2015-045859 proposes a toner having a composite fine particle in which an inorganic fine particle is embedded in a resin fine particle having a melting point of from 60° C. to 150° C. at the surface of the toner. By using this method, it is thought that the melting properties of the toner surface (the vicinity of the surface) can be improved and a certain level of developing performance can be achieved.

SUMMARY OF THE INVENTION

The invention disclosed in Japanese Patent Application Publication No. 2012-013776 reliably achieves advantageous effects in terms of physical properties that contribute to matters such as toner charging performance and fluidity. However, the trade off from this was that low temperature fixability was impaired.

In addition, because low temperature fixing performance depends only on the viscosity of the base in the invention disclosed in Japanese Patent Application Publication No. 2015-007765, the toner greatly deforms when subjected to heat, meaning that fixing non-uniformity readily occurs as a result of paper surface unevenness and image quality tends to deteriorate. In addition, because the crystalline polyester causes the toner as a whole to plasticize, the toner tends to remain in a molten state following fixing and discharged paper adhesion during continuous double-sided printing is also a serious problem.

In the invention disclosed in Japanese Patent Application Publication No. 2004-212740, fixing non-uniformity can be suppressed by increasing the meltability of the surface layer, but because a crystalline polyester is present at the surface layer of the toner, this greatly impairs the charging performance, fluidity and high-temperature high-humidity environmental characteristics of the toner, and sufficient balance with developing performance is not possible.

In the invention disclosed in Japanese Patent Application Publication No. 2015-045859, protruding parts of inorganic fine particles formed by embedding can, as a result of long term use, damage parts inside the cartridge that come into contact with the toner, such as the developing sleeve or the photosensitive drum, meaning that problems remain in terms of the durability of the cartridge as a whole. In the midst of such demands for higher speeds and longer service lives, improvements in surface layer melting performance must be considered in order to maintain toner durability so as to solve related problems such as image quality and discharged paper adhesion. There is a trade-off between toner durability and surface layer melting performance, and it is thought that there is still room for improvement in terms of overcoming this trade-off.

The purpose of the present invention is to provide a toner that can solve the problems mentioned above.

Specifically, the purpose of the present invention is to provide a toner which exhibits high developing performance and image quality even if surface layer melting performance is high, and a toner that exhibits good durability not only for the toner, but also for cartridge parts such as developing sleeves and photosensitive drums. That is, the purpose of the present invention is to provide a toner which can simultaneously overcome the trade-offbetween durability and melting performance in the vicinity of the toner surface, increase printing speed and service life, suppress discharged paper adhesion and improve image quality; and an external additive for the toner.

The present invention relates to a toner comprising: a toner particle containing a binder resin and a colorant; and an external additive, wherein the external additive is a core-shell type composite particle having:

a core containing an organic substance; and an organosilicon polymer coating layer on the surface of the core, a softening point of the toner particle is from 90° C. to 180° C., and when a curve for the variation (dE'/dT) in a storage elastic modulus E' [Pa] of the toner with respect to temperature T [° C.] is obtained on the basis of a curve of the temperature T—the storage elastic modulus E' of the toner, as determined by powder dynamic viscoelasticity measurements of the toner, the curve of the variation (dE'/dT) have relative minimum values of $-1.00\times10^{8}$ or less between an onset temperature and 90° C., and a relative minimum value on the lowest temperature side among the relative minimum values is $-1.35\times10^{-8}$ or less.

In addition, the present invention relates to a toner having: a toner particle containing a binder resin and a colorant; and an external additive, wherein the external additive is a core-shell type composite particle having:

a core containing a crystalline polyester resin; and an organosilicon polymer-containing coating layer on the surface of the core, a softening point of the toner particle is from 90° C. to 180° C., and a softening point (Tm) of the crystalline polyester resin is from 50° C. to 105° C.

In addition, the present invention relates to an external additive for a toner, which is a core-shell type composite particle having: a core containing a crystalline polyester resin; and an organosilicon polymer-containing coating layer on the surface of the core, wherein the softening point (Tm) of the crystalline polyester resin is from 50° C. to 105° C., a number average particle diameter Dn of the composite particle, as determined by a dynamic light scattering method, is from 50 nm to 300 nm, and a ratio (Dv/Dn) of a volume average particle diameter Dv and the Dn of the composite particle is 2.0 or less.

According to the present invention, it is possible to provide a toner which can simultaneously overcome the trade-off between durability and melting performance in the vicinity of the toner surface, increase printing speed and service life, suppress discharged paper adhesion and improve image quality; and an external additive for the toner.

Further features of the present invention will become apparent from the following description of exemplary embodiments with reference to the attached drawings.

DESCRIPTION OF THE EMBODIMENTS

Figure 1:
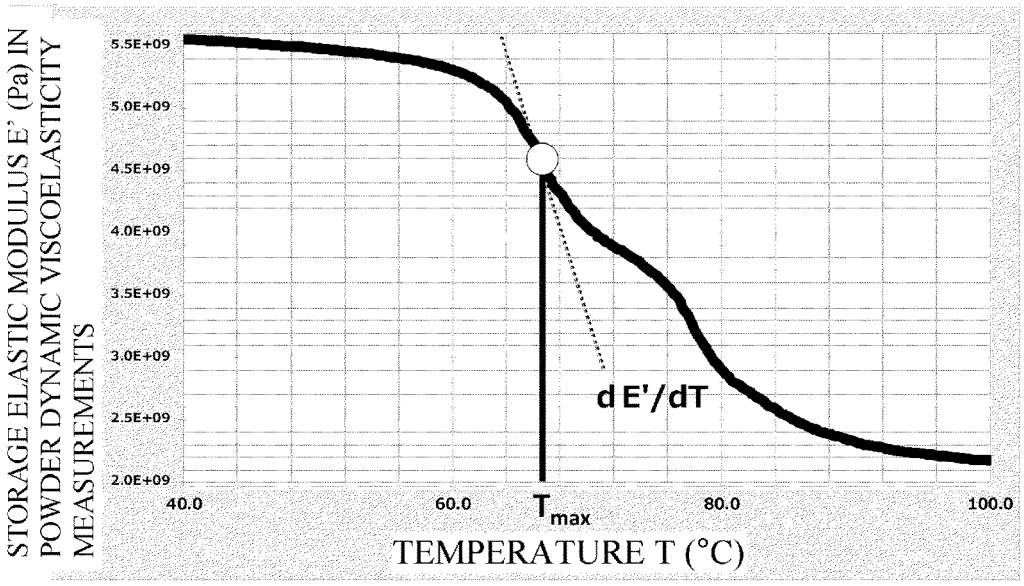
FIG. 1 shows a curve of temperature T [° C.]—toner storage elastic modulus E' [Pa], as determined by powder dynamic viscoelasticity measurements of the toner.

In the present invention, numerical ranges shown as "from OO to XX" and "OO to XX" mean numerical ranges that include the upper and lower limits, unless explicitly stated otherwise.

As mentioned above, overcoming the trade-off between durability and melting performance in the vicinity of the toner surface is a difficult challenge in technical terms. In cases where toner durability is to be maintained, it is effective to add an inorganic particle spacer at toner particle surfaces. However, adding large quantities of such spacer particles impairs melting of toner base particles at the time of fixing and has an adverse effect on low temperature fixing performance. In order to facilitate melting at the time of fixing, one method is to lower the viscosity of the toner base as a whole by adding a plasticizer such as a crystalline polyester to the toner base particles.

However, in cases where melting at the time of fixing depends on the viscosity of the toner base particles, this may cause a significant reduction in image quality. If the viscosity of the toner base at the time of fixing is low, toner particles undergo significant deformation when subjected to heat from a fixing heat roller, and melting non-uniformity between toner transferred to protruding parts on a paper surface, which have been subjected to a large amount of heat from the fixing heat roller, and toner transferred to recessed parts on the paper surface, which have been subjected to little heat, that is, fixing non-uniformity, tends to increase. This fixing non-uniformity leads to image density non-uniformity in an image and actually causes a significant deterioration in image quality.

This is not the only problem in cases where melting at the time of fixing depends on the viscosity of the toner base. In cases where melting at the time of fixing depends on the viscosity of the toner base particles, because the entire toner particle melts at the time of fixing, the toner tends to remain in a molten state on the paper following fixing. As a result, the problem of discharged paper adhesion readily occurs, in which adjacent sheets of paper adhere to each other during double-sided printing.

In order to maintain good low temperature fixability while preventing fixing non-uniformity and discharged paper adhesion, it is essential to consider melting at the time of fixing that does not depend only on the viscosity of the toner base particles. Specifically, it is thought that increasing the melting performance at the vicinity of the toner particle is important. In cases where the toner is heated by a fixing heat roller, adhesion occurs between the paper surface and the toner and also between the toner and the toner if the vicinity of the toner surface melts, and the toner can be fixed on the paper surface. In such cases, if the toner base particle has at least a certain degree of elasticity against heat, it is possible to minimize deformation of the toner particle. That is, it is possible to maintain good low temperature fixing while suppressing fixing non-uniformity.

In addition, in cases where only the vicinity of the toner surface melts, the proportion of the overall toner particle that melts is low, meaning that the toner rapidly solidifies on the paper following fixing. As a result, a toner is formed that is unlikely to suffer from discharged paper adhesion.

Furthermore, melting performance at the vicinity of the toner particle is also extremely important in the current situation in which there are demands for higher print speeds. As print speeds increase, higher speeds are also necessary in fixing processes. That is, the speed of paper passing through a fixing heat roller increases. As the speed of movement of the paper increases, the period of time that the paper is subjected to heat from the heat roller decreases, meaning that it is difficult for a sufficient amount of heat to penetrate into the inner part of the toner particle at the time of fixing. In cases where melting at the time of fixing depends on the viscosity of the toner base particle, it is not possible to adequately exhibit this effect in high speed fixing systems. Meanwhile, if melting performance at the vicinity of the toner surface is to be exhibited, it is thought that a heat-derived melting reaction is rapid, meaning that this potential can be adequately exhibited even in high speed fixing systems.

However, it is not easy to achieve good melting performance at the vicinity of the toner surface. Of course, if a substance that plasticizes the toner base particle, such as a crystalline polyester or low melting point wax, is present at the surface of the toner base particle, it is possible to facilitate surface layer melting. However, because this type of plasticizer exhibits poor charging performance and fluidity, in cases where the plasticizer is present at the vicinity of the toner particle, this is extremely disadvantageous in terms of toner transport properties and developing performance.

As a result of diligent research relating to problems such as those mentioned above, the inventors of the present invention found that a toner having the constitution mentioned above could achieve both good melting performance at the vicinity of the toner surface and good durability. That is, according to the present invention, it is possible to obtain a toner which exhibits excellent low temperature fixability and durability at high printing speeds, which produces little fixing non-uniformity and in which discharged paper adhesion is suppressed.

Specifically, the inventors of the present invention found that by using a toner having: a toner particle containing a binder resin and a colorant; and an external additive, wherein the external additive is a core/shell type composite particle having a core containing an organic substance, and an organosilicon polymer coating layer on the surface of the core, a softening point of the toner particle is from 90° C. to 180° C., and when a curve for the variation (dE'/dT) in a storage elastic modulus E' [Pa] of the toner with respect to temperature T [° C.] is obtained on the basis of a curve of the temperature T—the storage elastic modulus E' of the toner, as determined by powder dynamic viscoelasticity measurements of the toner, the curve for the variation (dE'/dT) have relative minimum values of $-1.00\times10^8$ or less between an onset temperature and 90° C., and a relative minimum value on the lowest temperature side among the relative minimum values is $-1.35\times10^8$ or less, melting performance near the toner surface and durability could both be achieved.

In addition, the inventors of the present invention also understood that by using a toner having: a toner particle containing a binder resin and a colorant; and an external additive, wherein the external additive is a core/shell type composite particle having: a core containing a crystalline polyester resin; and an organosilicon polymer-containing coating layer on the surface of the core, a softening point of the toner particle is from 90° C. to 180° C., and a softening point (Tm) of the crystalline polyester resin is from 50° C. to 105° C., melting performance near the toner surface and durability could both be achieved.

In the present invention, when a curve for the variation (dE'/dT) in the storage elastic modulus E' of the toner with respect to the temperature T [° C.] is obtained on the basis of a curve of the temperature T—the storage elastic modulus E' [Pa] of the toner, as determined by powder dynamic viscoelasticity measurements of the toner, it is extremely important that the curve for the variation (dE'/dT) have relative minimum values of $-1.00\times10^8$ or less between the onset temperature and 90° C. and a relative minimum value on the lowest temperature side among the relative minimum values is $-1.35\times10^8$ or less. In addition, it is also important that the softening point of the toner particle is from 90° C. to 180° C.

In these powder dynamic viscoelasticity measurements, the viscoelasticity of the toner can be measured in a powdered state, and the inventors of the present invention considered that the storage elastic modulus E' [Pa] indicated in these measurements indicates the state of melting of the toner when the toner behaves as a powder.

An example of a curve of temperature T [° C.]—toner storage elastic modulus E' [Pa], as determined by powder dynamic viscoelasticity measurements, for the toner of the present invention is shown in FIG. 1. According to FIG. 1, it is understood that in cases where the storage elastic modulus relative of the toner to the temperature is measured by powder dynamic viscoelasticity measurements, storage elastic modulus decreases in two stages. The inventors of the present invention think that the reason why this decrease is separated into two stages is because melting at the vicinity of the toner particle surface and melting of the toner as a whole occur at different points.

When the toner is subjected to heat from the outside, the vicinity of the toner surface is initially subjected to the heat, and it is therefore surmised that that the decrease in storage elastic modulus on the lowest temperature side means that melting progresses at the vicinity of the toner surface. In addition, if the softening point of the toner particle is from 90° C. to 180° C., this means that melting of the toner particle hardly progresses between the onset temperature and 90° C., and it is surmised that the decrease in storage elastic modulus on the lowest temperature side means that melting at the vicinity of the toner surface progresses due to the external additive. The softening point of the toner particle is preferably from 100*C to 150° C. Furthermore, the rate of decrease of storage elastic modulus relative to temperature indicates the speed of toner melting.

Therefore, it is thought that in the thus defined "when a curve for the variation (dE'/dT) in the storage elastic modulus E' of the toner with respect to the temperature T [° C.] is obtained on the basis of a curve of the temperature T—the storage elastic modulus E' [Pa] of the toner, as determined by powder dynamic viscoelasticity measurements of the toner, the curve for the variation (dE'/dT) have relative minimum values of $-1.00\times10^8$ or less between the onset temperature and 90° C., and a relative minimum value on the lowest temperature side among the relative minimum values" indicates the melting performance potential at the vicinity of the toner surface. The melting performance at the vicinity of the toner surface increases as this value decreases, that is, as the absolute value increases.

In order to achieve good melting performance, this relative minimum value must be $-1.35\times10^8$ or less, and is preferably $-1.80\times10^8$ or less, and more preferably $-2.00\times10^8$ or less. Meanwhile, the lower limit for this value is not particularly limited, but is preferably $-9.5\times10^8$ or more, and more preferably $-8.0\times10^8$ or more. This relative minimum value can be controlled by adjusting the added quantity or softening point of the composite particle or by adjusting the type of organic substance, or the like. In cases where this relative minimum value is to be reduced, examples of means for achieving this include use of a composite particle having a low softening point and use of a crystalline material in the organic substance.

In addition, it is extremely important that the external additive used in the present invention is a core/shell type composite particle having an organic substance-containing core and an organosilicon polymer-containing coating layer on the surface of the core.

Simply adding an organic substance in isolation has significant disadvantages in terms of toner durability and developing performance. In addition, simply adding a large quantity of an inorganic substance impairs melting at the vicinity of the toner surface at the time of fixing and means that satisfactory low temperature fixability cannot be achieved in current circumstances where printing speeds are increasing.

However, by coating the surface of the core with an organosilicon polymer, that is, by having an organosilicon polymer coating layer on the surface of a core that contains an organic substance, it is possible to ensure melting performance at the vicinity of the toner surface while ensuring good durability and developing performance.

Furthermore, a number of advantages occur as a result of having a core/shell type structure in which an organosilicon polymer forms a coating layer rather than simply having inorganic particles at the surface of the core.

One such advantage is discharged paper adhesion resistance. The mechanism for this is thought to be as follows. In cases where the organosilicon polymer forms a coating layer, silicon is present at the surface of the organic substance-containing core as a surface, not as a point. As a result, when the toner melts on the paper at the time of fixing, it is thought that the coating layer acts as a crystal nucleating agent or an inorganic filler and increases the viscosity of the toner on the paper following fixing. Conversely, in cases where inorganic particles are simply present at the surface of the organic substance-containing core, it is thought that the inorganic particles are only present as points, meaning that the effect of acting as a crystal nucleating agent or inorganic filler is hardly exhibited.

In addition, because the organosilicon polymer forms the coating layer, the hardness of the overall composite particle increases and the composite particle functions effectively as a spacer particle. Therefore, the durable developing performance of the toner is improved.

A further advantageous effect is thought to be suppression of abrasion of cartridge components. Because the organosilicon polymer forms a coating layer, it is surmised that the surface of the composite particle is smooth and is therefore unlikely to damage cartridge components such as developing sleeves and drums. Conversely, in cases where inorganic particles are simply present at the surface of the organic substance-containing core, relatively hard inorganic substances are present as protruding parts and readily damage cartridge components such as developing sleeves and drums. If damage to developing sleeves and drums progresses, streaks occur on images and durable developing performance deteriorates. These problems are particularly pronounced in high speed developing systems.

Furthermore, when the temperature at which the relative minimum value on the lowest temperature side is obtained is denoted by $T_{max}$ on the above-mentioned curve for the variation (dE'/dT), a storage elastic modulus $G'(T_{max})$ of the toner in dynamic viscoelasticity measurements when $T_{max}$ is reached is preferably $2.50\times10^8$ or more.

It is thought by the inventors of the present invention that in the curve for the variation (dE'/dT) of E' with respect to temperature T, the relative minimum value on the lowest temperature side indicates the melting performance potential at the vicinity of the toner surface and G' indicates the melting performance of the toner as a whole. That is, the storage elastic modulus $G'(T_{max})$ at the point where $T_{max}$ is reached indicates the melting properties of the toner as a whole at the point where melting at the vicinity of the toner surface has most progressed, and the vicinity of the toner surface selectively melts as this numerical value increases, and as this numerical value decreases, the melting performance at the toner surface depends on melting of the toner-based particle, that is, depends on melting of the toner as a whole.

As mentioned above, selective melting at the vicinity of the toner surface is preferred in order to achieve good image quality and discharged paper adhesion resistance. Furthermore, because this does not depend on melting of the toner base particle, it is also possible to suppress embedding of the external additive, which is caused by continuous duty, thereby contributing greatly to durability. In order to achieve these effects, the value of $G'(T_{max})$ is preferably $2.50\times10^8$ or more, more preferably $3.50\times10^8$ or more, and further preferably $4.00\times10^8$ or more. Meanwhile, the upper limit for the value of $G'(T_{max})$ is not particularly limited, but is preferably $1.0\times10^{10}$ or less, and more preferably $1.0\times10^9$ or less. The value of $G'(T_{max})$ can be controlled by adjusting the softening point or molecular weight of the toner particle.

Figure 2:
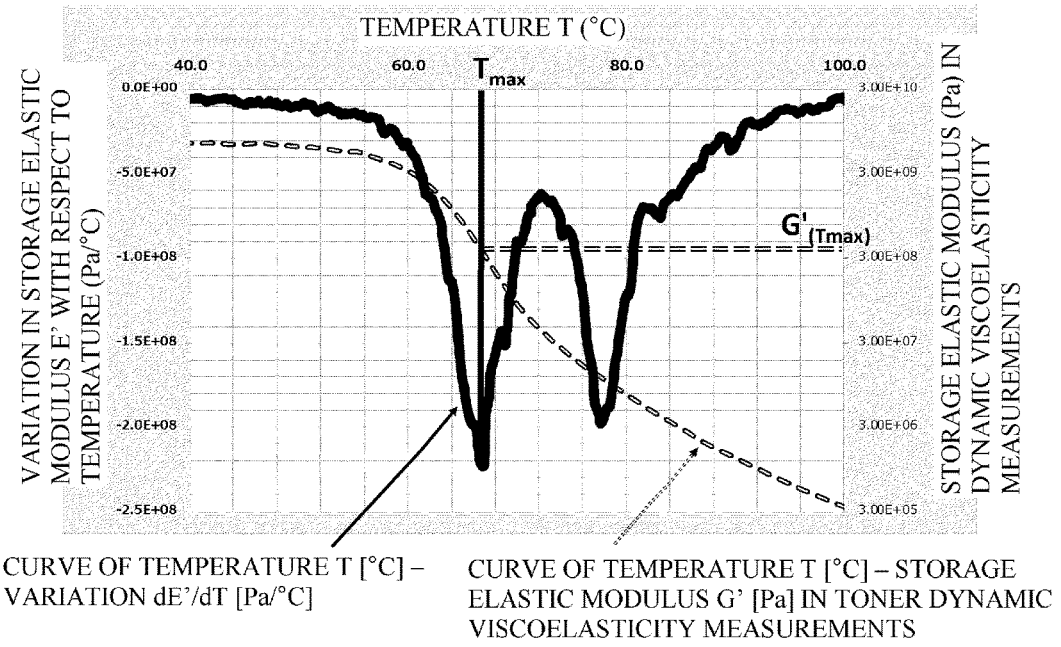
FIG. 2 shows a curve of temperature T [° C.]—variation dE'/dT and a curve of temperature T [° C.]—toner storage elastic modulus G' [Pa] in dynamic viscoelasticity measurements.

FIG. 2 shows a curve of temperature T [° C.]—variation dE'/dT and a curve of temperature T [° C.]—toner storage elastic modulus G' [Pa] in dynamic viscoelasticity measurements.

The organic substance used for the core of the composite particle is not particularly limited, and examples thereof include amorphous resins such as polyester resins, vinyl resins, epoxy resins and polyurethane resins, and crystalline materials such as waxes and crystalline polyester resins.

Furthermore, in cases where a function such as imparting the toner with good surface melting properties is considered, the softening point (Tm) of the core organic substance is preferably from 50° C. to 105° C., and more preferably from 50° C. to 85° C.

The acid value of the organic substance used in the core of the composite particle is preferably from 4 mg KOH/g to 20 mg KOH/g, and more preferably from 5 mg KOH/g to 19 mg KOH/g. If the acid value falls within this range, it is possible to achieve more stable developing performance.

The organic substance used in the core of the composite particle more preferably contains a crystalline polyester resin. If the organic substance contains a crystalline polyester resin, plasticizing of the base is facilitated, meaning that melting performance at the vicinity of the toner surface is further improved. In addition, because the organosilicon polymer at the vicinity of the surface acts as a crystal nucleating agent at the time of fixing melting, this is extremely effective in terms of discharged paper adhesion resistance. In addition to a crystalline polyester resin, the organic substance may contain a publicly known resin such as an amorphous polyester resin as long as the advantageous effect of the present invention is not impaired. It is more preferable for the organic substance to be a crystalline polyester. From the perspective of low temperature fixing, the softening point (Tm) of the crystalline polyester resin is preferably from 50° C. to 105° C., and more preferably from 60° C. to 100° C.

Moreover, crystalline means that a clear endothermic peak is observed in a reversible specific heat change curve of specific heat change measurements obtained using a differential scanning calorimeter (DSC).

The weight average molecular weight (Mw) of the crystalline polyester resin used for the inner part of the composite particle is preferably from 18,000 to 50,000, and more preferably from 25,000 to 50,000. If the weight average molecular weight (Mw) of the crystalline polyester resin falls within the desired range, the hardness is appropriate for an external additive, and durability is improved.

The crystalline polyester resin used in the inner part of the composite particle preferably has a urethane bond. By having a urethane bond, elasticity at high temperature increases. As a result, it is possible to suppress toner deformation when subjected to large amounts of heat at the time of fixing, and this is therefore extremely effective for improving fixing non-uniformity.

Examples of aliphatic diols able to be used to synthesize the crystalline polyester include the following.

1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, 1,20-eicosane diol, and the like. It is possible to use one of these diols in isolation or a mixture thereof. Moreover, aliphatic diols are not limited to these.

In addition, it is possible to use an aliphatic diol having a double bond as the aliphatic diol. Examples of aliphatic diols having a double bond include the following. 2-butene-1,4-diol, 3-hexene-1,6-diol, 4-octene-1,8-diol.

Mention will now be made of acid components able to be used when synthesizing the crystalline polyester. Polycarboxylic acids such as aliphatic dicarboxylic acids are preferred as the acid component.

Examples of aliphatic dicarboxylic acids include the following. Oxalic acid, malonic acid, succinic acid, glutaric acid, adipic acid, pimelic acid, suberic acid, azelaic acid, sebacic acid, 1,9-nonanedicarboxylic acid, 1,11-undecanedicarboxylic acid, 1,12-dodecanedicarboxylic acid, 1,13-tridecanedicarboxylic acid, 1,14-tetradecanedicarboxylic acid and 1,18-octadecanedicarboxylic acid. Further examples include lower alkyl ester and acid anhydrides of these dicarboxylic acids. It is possible to use one of these dicarboxylic acids in isolation or a mixture thereof. In addition, aliphatic dicarboxylic acids are not limited to these.

Examples of aromatic dicarboxylic acids include the following. Terephthalic acid, isophthalic acid, 2,6-naphthalenedicarboxylic acid and 4,4'-biphenyldicarboxylic acid. Of these, terephthalic acid is preferred from perspectives such as ease of procurement and ease of forming a low melting point polymer.

Furthermore, it is possible to use a dicarboxylic acid having a double bond as the acid component. Examples of such dicarboxylic acids include fumaric acid, maleic acid, 3-hexene dioic acid and 3-octene dioic acid. In addition, it is also possible to use a lower alkyl ester or acid anhydride of these acids. Of these, fumaric acid and maleic acid are preferred from the perspective of cost.

Examples of isocyanate components used to constitute the urethane bond include the following. Aromatic diisocyanates having from 6 to 20 carbon atoms (excluding carbon atoms in NCO groups, hereinafter also), aliphatic diisocyanates having from 2 to 18 carbon atoms, alicyclic diisocyanates having from 4 to 15 carbon atoms, modified products of these diisocyanates (modified products containing urethane groups, carbodiimide groups, allophanate groups, urea groups, biuret groups, uretdione groups, uretimine groups, isocyanurate groups or oxazolidone groups. Hereinafter referred to as modified diisocyanates), and mixtures of two or more types of these.

Examples of aliphatic diisocyanates include the following. Ethylene diisocyanate, tetramethylene diisocyanate, hexamethylene diisocyanate (HDI) and dodecamethylene diisocyanate.

Examples of alicyclic diisocyanates include the following. Isophorone diisocyanate (IPDI), dicyclohexylmethane-4,4'-diisocyanate, cyclohexane diisocyanate and methylcyclohexane diisocyanate.

Examples of aromatic diisocyanates include the following. m- and/or p-xylylene diisocyanate (XDI) and $\alpha,\alpha,\alpha',\alpha'$-tetramethylxylylene diisocyanate.

Of these, aromatic diisocyanates having from 6 to 15 carbon atoms, aliphatic diisocyanates having from 4 to 12 carbon atoms and alicyclic diisocyanates having from 4 to 15 carbon atoms are preferred, and HDI, IPDI and XDI are particularly preferred. In addition to the diisocyanates mentioned above, it is possible to use a trifunctional or higher isocyanate compound. The crystalline polyester is preferably a polymer of an isocyanate component and a condensate of an aliphatic diol and an aliphatic dicarboxylic acid. The content of structures derived from isocyanate compounds in the crystalline polyester is preferably from 0.5 parts by mass to 40.0 parts by mass with respect to 100 parts by mass of structures derived from aliphatic diols and aliphatic dicarboxylic acids.

The method for producing the crystalline polyester is not particularly limited, and it is possible to produce the crystalline polyester by means of an ordinary polyester polymerization method in which an acid component is reacted with an alcohol component. For example, it is possible to use a direct polycondensation method or a transesterification method as appropriate according to the types of monomer.

The crystalline polyester is preferably produced at a polymerization temperature of from 180° C. to 230° C. and, if necessary, it is preferable to carry out the reaction while reducing the pressure in the reaction system and removing water and alcohol generated during the condensation.

In cases where the monomers do not dissolve or are not compatible at the reaction temperature, the monomers should be dissolved by adding a high boiling point solvent as a solubilizing agent. The polycondensation reaction is carried out while distilling off the solubilizing agent. In cases where a monomer having poor compatibility is present in a copolymerization reaction, it is preferable to first condense the monomer having poor compatibility with an acid or alcohol expected to be able to undergo polycondensation with the monomer, and then polycondense together with the main component.

Examples of catalysts able to be used when producing the crystalline polyester include titanium catalysts and tin catalysts. Examples of titanium catalysts include titanium tetraethoxide, titanium tetrapropoxide, titanium tetraisopropoxide and titanium tetrabutoxide. In addition, examples of tin catalysts include dibutyl tin dichloride, dibutyl tin oxide and diphenyl tin oxide.

The content of the organic substance in the composite particle is preferably from 20 mass % to 95 mass %. At such a content, the external additive readily melts instantaneously when subjected to heat from a fixing unit, and it is possible to greatly improve the low temperature fixability of the toner.

The composite particle has an organosilicon polymer coating layer on the surface of the organic substance-containing core. Coating means a state whereby the organosilicon polymer forms a layer and coats the inner organic substance, and the organosilicon polymer may completely coat the inner organic substance, but a part of the organic substance may be exposed.

A publicly known method can be used to form the organosilicon polymer coating layer on the composite particle.

For example, one method is to use a silane coupling agent. The organic substance core that serves as the base is dispersed in an organic solvent. This solution is added dropwise to an aqueous phase, and the solvent is then removed so as to produce a dispersion solution of core fine particles. After adjusting the pH of the dispersion solution, a silane coupling agent is added. According to this method, the silane coupling agent brings about hydrolysis and polycondensation in the dispersion solution, and the coating layer is deposited on the surface of the core fine particles as a result of hydrophobic interactions. In this way, it is possible to form the organosilicon polymer coating layer on the surface of the core fine particle.

In addition, it is possible to use a polymerizable silane coupling agent. When a polymerizable silane coupling agent having a vinyl group or the like is deposited on the surface of a core fine particle, by adding a radical initiator such as potassium persulfate, vinyl polymerization progresses at the surface of the core fine particle. In this way, a strong organosilicon polymer coating layer can be formed. By forming a strong coating layer, the durability of the toner can be improved.

The compounds listed below can be advantageously used as the silane coupling agent.

Vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, n-phenyl-γ-aminopropyltrimethoxysilane and methacryloxypropyltrimethoxysilane.

The composite particle may be surface-treated with an organosilicon compound or a silicone oil. By treating with an organosilicon compound or a silicone oil, it is possible to increase hydrophobicity, thereby enabling a toner having stabilized developing performance in high temperature high humidity environments to be obtained. Examples of organosilicon compounds include the following.

Hexamethyldisilazane, methyltrimethoxysilane, octyltrimethoxysilane, isobutyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, (bromomethyl)dimethylchlorosilane, α-(chloroethyl) trichlorosilane, β-(chloroethyl)trichlorosilane, (chloromethyl)dimethylchlorosilane, triorganosilylmercaptans, trimethylsilylmercaptan, triorganosilyl acrylates, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxanes having 2 to 12 siloxane units and one Si-bonded hydroxyl group at a terminal per molecule. It is possible to use one of these organosilicon compounds, or a mixture of two or more types thereof.

A silicone oil having a viscosity at 25° C. of from 30 $mm^2/s$ to 1000 $mm^2/s$ is preferred. Specific examples of such silicone oils include dimethylsilicone oils, methylphenylsilicone oils, α-methyl styrene-modified silicone oils, chlorophenylsilicone oils and fluorine-modified silicone oils.

Examples of silicone oil treatment methods include the following. A method of directly mixing silane coupling agent-treated composite particles with a silicone oil using a mixer such as a Henschel mixer. A method of spraying a silicone oil onto composite particles. In addition, a more preferred method is a method of dissolving or dispersing a silicone oil in an appropriate solvent, adding composite particles, mixing and then removing the solvent.

The composite particles preferably have a number average particle diameter Dn, as measured using a dynamic light scattering method, of from 30 nm to 500 nm. If the number average particle diameter falls within the range mentioned above, the toner readily adheres to the paper at the time of transfer and at the time of fixing, and it is possible to achieve good transferability and fixing performance. In addition, functionality as a spacer tends to improve. The number average particle diameter Dn is more preferably from 50 nm to 300 nm.

In addition, the ratio (Dv/Dn) of volume average particle diameter Dv and Dn of the composite particles is preferably 2.0 or less, and more preferably 1.8 or less. The lower limit for this ratio is not particularly limited, but is preferably 1.5 or more. This Dv/Dn ratio is an indicator of uniformity of particle diameter, and if this ratio is 2.0 or less, the particle size distribution is sharp, meaning that melting non-uniformity between particles is suppressed and fixing non-uniformity is improved.

The content of the composite particle in the toner is preferably from 0.2 parts by mass to 10 parts by mass with respect to 100 parts by mass of toner particles. If this content is 0.2 parts by mass or more, melting at the vicinity of the toner surface is improved, and if this content is 10 parts by mass or less, fixing non-uniformity hardly occurs because it is possible to maintain the elasticity of the base at the time of fixing.

The toner according to the present invention may contain other external additives in addition to the composite particle. In order to improve the fluidity and charging performance of the toner in particular, it is preferable to add a flowability improver as another external additive. The compounds listed below can be used as the flowability improver.

For example, fluororesin powders such as vinylidene fluoride fine powders and polytetrafluoroethylene fine powders; finely powdered silica such as wet silica or dry silica; finely powdered titanium oxide, finely powdered alumina and products obtained by surface treating same with a silane compound, a titanium coupling agent or a silicone oil; oxides such as zinc oxide and tin oxide; composite oxides such as strontium titanate, barium titanate, calcium titanate, strontium zirconate and calcium zirconate; and carbonate compounds such as calcium carbonate and magnesium carbonate.

A preferred flowability improver is a fine powder produced by vapor phase oxidation of a silicon halide, that is, so-called dry silica or fumed silica. For example, a pyrolysis reaction of silicon tetrachloride gas in an oxyhydrogen flame is used, and the basic reaction formula is as follows.

$$SiCl_4+2H_2+O_2 \rightarrow SiO_2+4HCl$$

In this production process, by using another metal halide such as aluminum chloride or titanium chloride together with the silicon halide, it is possible to obtain a composite fine powder of silica and another metal oxide, and such composite fine powders are encompassed by silica. If the average primary particle diameter in a number-based particle size distribution is from 5 nm to 30 nm, it is possible to achieve high charging performance and high fluidity.

It is more preferable for the flowability improver to be a treated silica fine powder obtained by hydrophobizing a silica fine powder produced by vapor phase oxidation of the silicon halide. The hydrophobization treatment can be a method similar to that used for treating the surface of the composite particle. The flowability improver preferably has a nitrogen adsorption specific surface area, as measured using the BET method, of from 30 $m^2/g$ to 300 $m^2/g$. In addition, it is preferable to use the flowability improver at a quantity of from 0.01 parts by mass to 3 parts by mass with respect to 100 parts by mass of toner particles.

The toner can be used as a single component developer by mixing the toner with the flowability improver and, if necessary, with other external additives (a charge control agent or the like). In addition, the toner can be used as a two-component developer used with a carrier. When used in a two-component developing method, a conventional publicly known carrier can be used.

Specifically, a surface oxidized or unoxidized metal such as iron, nickel, cobalt, manganese, chromium or a rare earth metal, or an alloy or oxide of these, can be advantageously used. In addition, an article obtained by depositing or coating a substance such as a styrene-based resin, an acrylic resin, a silicone-based resin, a fluororesin or a polyester resin on the surface of these carrier particles can be advantageously used.

An explanation will now be given of the toner particle.

First, the binder resin used in the toner particle will be described in detail.

Examples of the binder resin include polyester resins, vinyl resins, epoxy resins and polyurethane resins. From the perspective of homogeneously dispersing a polar charge control agent in particular, incorporating a polyester resin, which generally exhibit high polarity, is preferred from the perspective of developing performance.

In addition, in view of the function of imparting good melting performance at the vicinity of the toner surface, the toner has a composite particle having excellent melting characteristics in the present invention. Therefore, the softening point Tm of the toner particle is preferably higher than the softening point Tm of the composite particle.

In order to maximize the effect of melting characteristics at the vicinity of the toner surface, the softening point (Tm) of the toner particle is set to be from 90° C. to 180° C. This softening point is more preferably from 110° C. to 170° C. from the perspectives of superior melting characteristics at the vicinity of the toner surface and superior toner durability.

In addition, the glass transition temperature (Tg) is preferably from 45° C. to 70° C. from the perspective of storage stability.

It is possible to further incorporate magnetic iron oxide particles in the toner particle and use the toner particle as a magnetic toner. In such cases, the magnetic iron oxide can also function as a colorant. Examples of magnetic iron oxide particles contained in magnetic toners include iron oxide such as magnetite, hematite and ferrite; metals such as iron, cobalt and nickel; and alloys and mixtures of these metals with metals such as aluminum, cobalt, copper, lead, magnesium, tin, zinc, antimony, bismuth, calcium, manganese, titanium, tungsten and vanadium.

The number average particle diameter of these magnetic iron oxide particles is preferably 2 μm or less. This number average particle diameter is more preferably from 0.05 μm to 0.5 μm. The content of the magnetic iron oxide particles in the toner is preferably from 20 parts by mass to 200 parts by mass, and more preferably from 40 parts by mass to 150 parts by mass, with respect to 100 parts by mass of the binder resin.

Examples will now be given of colorants used in the present invention.

For example, carbon black, grafted carbon black and materials stained black using the following yellow/magenta/cyan colorants can be used as black colorants. Examples of yellow colorants include condensed azo compounds, isoindolinone compounds, anthraquinone compounds, azo metal complexes, methine compounds and allylamide compounds. Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Examples of cyan colorants include copper phthalocyanine compounds and derivatives thereof, anthraquinone compounds and basic dye lake compounds.

These colorants can be used singly or as a mixture, and can be used in the form of solid solutions. These colorants are selected in view of hue angle, chroma, lightness, weather resistance, OHP transparency and dispersibility in the toner. The colorant content is preferably from 1 part by mass to 20 parts by mass with respect to 100 parts by mass of the binder resin.

The toner may contain a wax in order to impart release properties at the time of fixing.

Examples of waxes include aliphatic hydrocarbon-based waxes, such as polyolefin copolymers, polyolefin waxes, microcrystalline waxes, paraffin waxes and Fischer Tropsch waxes, and ester waxes.

The wax content is preferably from 0.2 parts by mass to 10.0 parts by mass with respect to 100 parts by mass of the binder resin.

The toner may contain a charge control agent in order to stabilize the triboelectric charge properties of the toner. Charge control agents that negatively charge a toner and charge control agents that positively charge a toner are known, and it is possible to use a variety of charge control agents, either singly or as a combination of two or more types thereof, depending on the type and intended use of the toner.

Examples of charge control agents that negatively charge a toner include the following. Organic metal complexes (monoazo metal complexes; acetylacetone metal complexes); and metal complexes and metal salts of aromatic hydroxycarboxylic acids and aromatic dicarboxylic acids. Other examples include aromatic mono- and poly-carboxylic acids and metal salts and anhydrides thereof; and esters, and phenol derivatives such as bisphenol. Examples of charge control agents that positively charge a toner include the following. Products modified by means of nigrosine and fatty acid metal salts; quaternary ammonium salts such as tributylbenzyl ammonium-1-hydroxy-4-naphthosulfonic acid salts, tetrabutyl ammonium tetrafluoroborate, and analogs thereof, onium salts such as phosphonium salts, and lake pigments thereof; triphenylmethane dyes and Lake pigments thereof (examples of laking agents include phosphotungstic acid, phosphomolybdic acid, phosphotungstic-molybdic acid, tannic acid, lauric acid, gallic acid, ferricyanic acid and ferrocyanic compounds); and metal salts of higher fatty acids.

The method for producing the toner particle is not particularly limited, and it is possible to use a pulverization method or a so-called polymerization method, such as an emulsion polymerization method, a suspension polymerization method or a dissolution suspension method.

In a pulverization method, the binder resin and colorant that constitute the toner particle and, if necessary, additives such as waxes and charge control agents, are thoroughly mixed using a mixer such as a Henschel mixer or a ball mill. Next, the obtained mixture is melt kneaded using a hot kneader such as a twin screw kneading extruder, a hot roller, a kneader or an extruder, cooled, solidified, pulverized and classified so as to obtain toner particles.

If necessary, toner particles can be obtained by mixing required external additives by means of a mixer such as a Henschel mixer.

Descriptions will now be given of methods for measuring physical properties relating to the present invention.

Method for Measuring Powder Dynamic Viscoelasticity

Approximately 50 mg of toner is precisely measured out and placed in an attached material pocket (height×width×thickness: 17.5 mm×7.5 mm×1.5 mm) so that the toner is in the center of the pocket, and measurements are then carried out using a powder dynamic viscoelasticity measuring apparatus (DMA8000 available from PerkinElmer Inc.). Measurements are carried out under the following conditions using the measurement wizard.

Frequency: Single frequency of 1 Hz
Amplitude: 0.05 mm
Ramp rate: 2° C./min
Start temperature: 30° C.
Final temperature: 180° C.
Data acquisition interval: 0.3 seconds On a curve of the temperature T [° C.]—the storage elastic modulus E' [Pa] of the toner, as determined by the powder dynamic viscoelasticity measurements, the variation (dE'/ dT) in E' with respect to temperature T is measured at approximately 1.5 seconds before and after each temperature. In this method, the variation (dE'/dT) is calculated for the temperature range of from 30° C. to 180° C., and a curve for the variation (dE'/dT) of the storage elastic modulus E' of the toner with respect to the temperature T (a curve of temperature T [° C.]—variation dE'/dT) is obtained. On the curve of temperature T [° C.]—variation dE'/dT, relative minimum values of $-1.00\times10^8$ or less are specified within the range between the onset temperature and 90° C., and a relative minimum value for the variation (dE'/dT) that initially appears from the low temperature side among the relative minimum values is calculated.

In addition, the onset temperature on the curve of temperature T [° C.]–variation dE'/dT means the temperature at the point where a straight line obtained by extending the low temperature side base line of the E' curve towards the high temperature side intersects with a tangential line drawn from the point where the gradient of the E' curve is a maximum.

Method for Measuring Dynamic Viscoelasticity

Dynamic viscoelasticity is measured using an "Ares" rotating plate rheometer (available from TA Instruments).

A sample obtained by pressure molding 0.2 g of a toner into the shape of a disk having a diameter of 7.9 mm and a thickness of 2.0±0.3 mm using a tablet molding machine (10 MPa, 60 seconds) in an atmosphere having a temperature of 25° C. is used as a measurement sample.

The sample is disposed between parallel plates, the temperature is increased from room temperature (25° C.) to 100° C. for 15 minutes, the shape of the sample is adjusted, the sample is then cooled to the viscoelasticity measurement start temperature, and measurements are then started. Here, the sample is set in such a way that the initial normal force is 0. In addition, by adjusting the automatic tension (to Auto Tension Adjustment ON), it is possible to cancel out effects of normal forces in subsequent measurements, as explained below. By means of these measurements, it is possible to obtain a temperature T [*C]–toner storage elastic modulus G' [Pa] curve.

The measurements are carried out under the following conditions.

(1) Parallel plates having diameters of 7.9 mm are used.
(2) The frequency is 6.28 rad/sec (1.0 Hz).
(3) The initial applied strain is set to 0.1%.
(4) Within the range from 30° C. to 200° C., measurements are carried out at a ramp rate of 2.0° C./min. Moreover, measurements are carried out under the following preset conditions for automatic adjustment mode. Measurements are carried out under Auto Strain mode.
(5) The Max Applied Strain is set to 20.0%.
(6) The Max Allowed Torque is set to 200.0 g·cm, and the Min Allowed Torque is set to 0.2 g·cm.
(7) Strain Adjustment is set to 20.0% of Current Strain. Auto Tension mode is used for the measurements.
(8) Auto Tension Direction is set to Compression.
(9) Initial Static Force is set to 10.0 g, and Auto Tension Sensitivity is set to 40.0 g.
(10) Auto Tension operation conditions are a Sample Modulus of $1.0\times10^3$ Pa or more.

Method for Measuring Acid Value

Acid value is the number of milligrams of potassium hydroxide required to neutralize acid contained in 1 g of a sample. Acid value is measured in accordance with JIS K 0070-1992, but is specifically measured using the following procedure.

(1) Reagent Preparation

A phenolphthalein solution is obtained by dissolving 1.0 g of phenolphthalein in 90 mL of (95 vol. %) ethyl alcohol and then adding ion exchanged water up to 100 mL.

7 g of special grade potassium hydroxide is dissolved in 5 mL of water, and (95 vol. %) ethyl alcohol is added up to 1 L.

A potassium hydroxide solution is obtained by placing the obtained solution in an alkali-resistant container so as not to be in contact with carbon dioxide gas or the like, allowing solution to stand for 3 days, and then filtering. The obtained potassium hydroxide solution is stored in the alkali-resistant container. The factor of the potassium hydroxide solution is determined by placing 25 mL of 0.1 M hydrochloric acid in a conical flask, adding several drops of the phenolphthalein solution, titrating with the potassium hydroxide solution, and determining the factor from the amount of the potassium hydroxide solution required for neutralization. The 0.1 M hydrochloric acid was prepared in accordance with JIS K 8001-1998.

(2) Operation (A) Main Test 2.0 g of a sample is measured precisely into a 200 mL conical flask, 100 mL of a mixed toluene/ethanol (2:1) solution is added, and the sample is dissolved for 5 hours. Next, several drops of the phenolphthalein solution are added as an indicator, and titration is carried out using the potassium hydroxide solution. Moreover, the endpoint of the titration is deemed to be the point when the pale crimson color of the indicator is maintained for approximately 30 seconds.

(B) Blank Test

Titration is carried out in the same way as in the operation described above, except that the sample is not used (that is, only a mixed toluene/ethanol (2:1) solution is used).

(3) Calculation of Acid Value $$AV=[(B-AB)\times f\times5.61]/S$$

Here, AV denotes the acid value (mg KOH/g), A denotes the added amount (mL) of the potassium hydroxide solution in the blank test, B denotes the added amount (mL) of the potassium hydroxide solution in the main test, f denotes the factor of the potassium hydroxide solution, and S denotes the mass (g) of the sample.

Measurement of Weight Average Molecular Weight Mw and Number Average Molecular Weight Mn by GPC A column is stabilized in a heat chamber at 40° C., the column is flushed at this temperature using THF as a solvent at a flow rate of 1 mL/min, approximately 100 μL of a THF sample solution is injected, and measurements are then carried out.

When measuring the molecular weight of the sample, the molecular weight distribution of the sample is calculated from the relationship between count and logarithmic values on a calibration curve prepared using a plurality of monodispersed polystyrene standard samples.

Samples having molecular weights of approximately $10^2$ to $10^7$ available from, for example, Tosoh Corporation or Showa Denko K.K. are used as standard polystyrene samples for preparing calibration curves, and use of approximately 10 standard polystyrene samples is appropriate.

In addition, the detector is a refractive index (RI) detector. Moreover, a combination of multiple commercially available polystyrene gel columns should be used as columns, and it is possible to use, for example, a combination of Shodex GPC KF-801, 802, 803, 804, 805, 806, 807 and 800P available from Showa Denko K.K. or a combination of TSKgel G1000H ($H_{XL}$), G2000H ($H_{XL}$), G3000H ($H_{XL}$), G4000H ($H_{XL}$), G5000H ($H_{XL}$), G6000H (HL), G7000H ($H_{XL}$) and TSK guard column available from Tosoh Corporation.

In addition, a sample is prepared in the manner described below.

A sample is placed in THF and allowed to stand for 5 hours, and then vigorously shaken and dissolved in the THF until no sample agglomerates remain. With the dissolution temperature being 25° C. as a basic rule, the solution is dissolved at a temperature of from 25° C. to 50° C. according to the solubility of the sample. The solution was then stored in a stationary state at 25° C. for 12 hours or longer.

Here, the length of time for which the sample is allowed to stand in the THF is made to be 24 hours. Next, a GPC sample is obtained by passing the solution through a sample treatment filter (pore size from 0.2 μm to 0.5 μm, for example, it is possible to use a Mishoridisk H-25-2 (available from Tosoh Corporation)). In addition, the sample concentration is adjusted so that the resin component content is from 0.5 mg/mL to 5.0 mg/mL.

Method for Confirming Urethane Bonds in Crystalline Polyester Resin

The presence/absence of urethane bonds is confirmed by FT-IR spectra obtained using an ATR method. FT-IR spectra obtained using an ATR method are obtained using a Frontier (Fourier transform infrared spectroscopy analyzer, available from PerkinElmer Inc.) equipped with a Universal ATR Sampling Accessory.

Ge ATR crystals (refractive index 4.0) are used as ATR crystals.

Other conditions are as follows.

Range
Start: 4000 $cm^{-1}$
End: 600 $cm^{-1}$ (Ge ATR crystals)
Scan number: 8
Resolution: 4.00 $cm^{-1}$
Advanced: $CO_2/H_2O$ (with correction)

If a peak top is present within the range 1570 to 1510 $cm^{-1}$, it is assessed that urethane bonds are present.

Measurement of Softening Point (Tm) of Toner Particle and Organic Substance (Crystalline Polyester Resin)

The softening point of the toner particle and the organic substance is measured using a constant load extrusion type capillary rheometer "Flow Tester CFT-500D Flow Characteristics Analyzer" (available from Shimadzu Corporation), with the measurements being carried out in accordance with the manual provided with the apparatus. In this apparatus, the temperature of a measurement sample filled in a cylinder is increased while a constant load is applied from above by means of a piston, thereby melting the sample, the molten measurement sample is extruded through a die at the bottom of the piston, and a flow curve can be obtained from the amount of piston travel and the temperature during this process.

The softening temperature was taken to be the "melting temperature by the half method" described in the manual provided with the "Flow Tester CFT-500D Flow Characteristics Analyzer". Moreover, the melting temperature by the half method is calculated as follows. First, half of the difference between the amount of piston travel at the completion of outflow ($S_{max}$) and the amount of piston travel at the start of outflow ($S_{min}$) is determined (This is designated as X. $X=(S_{max}-S_{min})/2$). Next, the temperature in the flow curve when the amount of piston travel reaches the sum of X and $S_{min}$ is taken to be the melting temperature by the half method. The measurement sample is prepared by subjecting approximately 1.0 g of a sample to compression molding for approximately 60 seconds at approximately 10 MPa in a 25° C. environment using a tablet compression molder (for example, NT-100H available from NPa System Co., Ltd.) to provide a cylindrical shape with a diameter of approximately 8 mm.

The measurement conditions for the Flow Tester CFT-500D are as follows.

Test mode: rising temperature method
Temperature increase rate: 4° C./min
Start temperature: 40° C.
End point temperature: 200° C.
Measurement interval: 1.0° C.
Piston cross section area: 1.000 $cm^2$
Test load (piston load): 10.0 kgf (0.9807 MPa)
Preheating time: 300 sec
Diameter of die orifice: 1.0 mm
Die length: 1.0 mm Measurement of Glass Transition Temperature Tg The glass transition temperature Tg is measured in accordance with ASTM D3418-82 using a "Q2000" differential scanning calorimeter (available from TA Instruments). Temperature calibration of the detector in the apparatus is performed using the melting points of indium and zinc, and heat amount calibration is performed using the heat of fusion of indium. Specifically, approximately 2 mg of a sample is precisely weighed out and placed in an aluminum pan, an empty aluminum pan is used as a reference, and measurements are carried out within a measurement temperature range of from −10° C. to 200° C., at a ramp rate of 10° C./min. Moreover, when carrying out measurements, the temperature is once increased to 200° C., then lowered to −10° C. at a rate of 10° C./min, and then increased again at a rate of 10° C./min. A change in specific heat is determined within the temperature range of from 30° C. to 100° C. in this second temperature increase step. Here, the glass transition temperature Tg is deemed to be the point at which the differential thermal analysis curve intersects with the line at an intermediate point on the baseline before and after a change in specific heat occurs.

Methods for Measuring Number Average Particle Diameter and Volume Average Particle Diameter of Primary Particles of Composite Particle (External Additive)

The number average particle diameter Dn and volume average particle diameter Dv of the composite particle are measured in the manner described below.

Number average particle diameter is measured using a Zetasizer Nano-ZS (available from Malvern Instruments Ltd).

This apparatus can measure particle diameters using a dynamic light scattering method. First, a sample to be measured is diluted so as to have a solid/liquid ratio of 0.10 mass % (±0.02 mass %), and then collected in a quartz cell and placed in a measurement section. Measurements are carried out after inputting the refractive index of the sample and the refractive index, viscosity and temperature of the dispersion solvent as measurement conditions using Zetasizer software 6.30 control software. Dn is used as number average particle diameter and Dv is used volume average particle diameter.

Because the composite particle is a composite of an inorganic fine particle and a resin fine particle, the refractive index is calculated by obtaining a weight average from the refractive index of the inorganic fine particle and the refractive index of the resin used in the resin fine particle. The refractive index of the inorganic fine particle is obtained from chemistry manuals. The refractive index listed in the control software as the refractive index of the resin used in the resin fine particle is used as the refractive index of the resin fine particle. However, in cases where no refractive index is listed in the control software, the value listed in the polymer database of the National Institute for Materials Science is used.

Numerical values listed in the control software are selected as values for the refractive index, viscosity and temperature of the dispersion solvent. In the case of a mixed solvent, a weight average of the mixed dispersion solvents is used.

EXAMPLES

The present invention will now be explained in greater detail by means of the following production examples, but is in no way limited to these examples.

Numbers of parts used in the examples mean parts by mass unless explicitly indicated otherwise.

Production Example of Crystalline Resin 1

(Acid component) decanedicarboxylic acid: 159 parts (Alcohol component) 1,6-hexane diol: 90 parts The raw materials listed above were placed in a reaction vessel equipped with a stirrer, a temperature gauge and a nitrogen inlet tube. Next, tetraisobutyl titanate was introduced at a quantity of 0.1 mass % relative to the overall quantity of the raw materials listed above, a reaction was allowed to progress at 180° C. for 4 hours, after which the temperature was increased to 210° C. at a rate of 10° C./hour, the temperature was then held at 210° C. for 8 hours, and a reaction was then allowed to progress for 1 hour at a pressure of 8.3 kPa, thereby obtaining crystalline polyester resin 1. Crystalline polyester resin 1 had a softening point of 62° C., a weight average molecular weight Mw of 21,000 and an acid value of 19 mg KOH/g.

Figure 3:
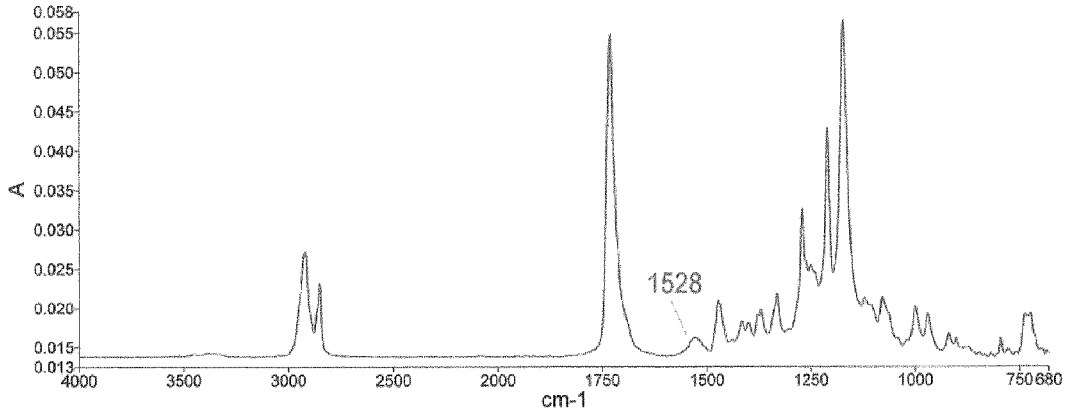
FIG. 3 shows FT-IR spectrum of crystalline resin 1.

Next, crystalline polyester resin 1 was placed in a reaction vessel equipped with a stirrer, a temperature gauge and a nitrogen inlet tube. Hexamethylene diisocyanate (HDI) as an isocyanate component was introduced at a quantity of 14 parts relative to 100 parts of the acid component and alcohol component, and tetrahydrofuran (THF) was then added so that the concentration of crystalline polyester resin 1 and HDI was 50 mass %. The reaction mixture was heated to 50° C., and an urethanation reaction was carried out for 10 hours. Crystalline resin 1 was then obtained by distilling off the THF solvent. Crystalline resin 1 had a peak top at 1528 $cm^{-1}$ in FT-IR measurements, and it was confirmed that urethane bonds were present. In addition, crystalline resin 1 had a clear endothermic peak in differential scanning calorimetry (DSC) measurements. The softening point and weight average molecular weight Mw are shown in Table 1. FIG. 3 shows a FT-IR spectrum of crystalline resin 1.

Production Examples of Crystalline Resins 2 to 6

Crystalline resins 2 to 6 were obtained by altering the monomer formulation, presence/absence of urethane bonds and isocyanate component from those in the production example of crystalline resin 1 in the manner shown in Table 1, and adjusting reaction conditions. Added monomer quantities were similar in terms of number of parts to those in the production example of crystalline resin 1. Physical properties of crystalline resins 2 to 6 are shown in Table 1. Moreover, crystalline resins 2 to 6 each had a clear endothermic peak in differential scanning calorimetry (DSC) measurements.

TABLE 1

| | Composition | | | | Softening | Weight average | Acid |
|---|---|---|---|---|---|---|---|
| | Acid component | Alcohol component | Isocyanate component | Urethane bond | point (° C.) | molecular weight Mw | value (mgKOH/g) |
| Crystalline resin 1 | Decanedicarboxylic acid | 1,6-hexane diol | Hexamethylene diisocyanate | Present | 62 | 21000 | 19 |
| Crystalline resin 2 | Terephthalic acid | 1,6-hexane diol | Hexamethylene diisocyanate | Present | 90 | 27000 | 14 |
| Crystalline resin 3 | Decanedicarboxylic acid | 1,6-hexane diol | Isophorone diisocyanate | Present | 70 | 50000 | 5 |
| Crystalline resin 4 | Decanedicarboxylic acid | 1,6-hexane diol | — | Absent | 63 | 25000 | 8 |
| Crystalline resin 5 | Terephthalic acid | 1,6-hexane diol | — | Absent | 92 | 18000 | 11 |
| Crystalline resin 6 | Sebacic acid | 1,10-decane diol | — | Absent | 76 | 16000 | 12 |

Production Example of Amorphous Resin 1

Adduct of (2.2 moles of) propylene oxide to bisphenol A: 60.0 parts by mole

Adduct of (2.2 moles of) ethylene oxide to bisphenol A: 40.0 parts by mole

Terephthalic acid: 77.0 parts by mole

Trimellitic anhydride: 3.0 parts by mole

The polyester monomer mixture listed above was placed in a 5 L autoclave, and tetraisobutyl titanate was added at a quantity of 0.05 mass % relative to the overall quantity of the polyester monomer mixture. A reflux condenser, a moisture separator, a nitrogen gas inlet tube, a temperature gauge and a stirrer were attached to the autoclave, and a polycondensation reaction was carried out at 230° C. while introducing nitrogen gas into the autoclave. The reaction time was adjusted so as to achieve the desired softening point. Following completion of the reaction, the reaction mixture was removed from the vessel, cooled and then pulverized so as to obtain amorphous resin 1. Physical properties of amorphous resin 1 are shown in Table 2.

Production Example of Amorphous Resin 2

Adduct of (2.2 moles of) propylene oxide to bisphenol A: 60.0 parts by mole

Adduct of (2.2 moles of) ethylene oxide to bisphenol A: 40.0 parts by mole

Terephthalic acid: 77.0 parts by mole

The polyester monomer mixture listed above was placed in a 5 L autoclave, and tetraisobutyl titanate was added at a quantity of 0.05 mass % relative to the overall quantity of the polyester monomer mixture. A reflux condenser, a moisture separator, a nitrogen gas inlet tube, a temperature gauge and a stirrer were attached to the autoclave, and a polycondensation reaction was carried out at 230° C. while introducing nitrogen gas into the autoclave. The reaction time was adjusted so as to achieve the desired softening point. Following completion of the reaction, the reaction mixture was removed from the vessel, cooled and then pulverized so as to obtain amorphous resin 2. Physical properties of amorphous resin 2 are shown in Table 2.

TABLE 2

| Amorphous resin | Glass transition temperature Tg ° C. | Softening point Tm ° C. | Acid value mgKOH/g |
|---|---|---|---|
| Amorphous resin 1 | 59 | 130 | 28 |
| Amorphous resin 2 | 55 | 93 | 5 |

Production Example of Composite Particle 1

Production of Organic Substance Fine Particle

Preparation of Aqueous Phase 50 parts of ion exchanged water is placed in a No. 11 mayonnaise jar, and 0.2 parts of sodium lauryl sulfate is dissolved in the ion exchanged water.

Preparation of Oil Phase 3 parts of crystalline resin 1 is dissolved in 7 parts of toluene.

The oil phase is added to the stirred aqueous phase, and dispersion is carried out for 5 minutes using an ultrasonic homogenizer (intermittently, 1 s of irradiation and 1 s of non-irradiation). Next, organic substance-containing core fine particle 1 was obtained by removing the toluene using an evaporator and removing excess sodium lauryl sulfate using an ultrafiltration filter.

Formation of Coating Layer

The pH of core fine particle 1 is measured and 10 mass % hydrochloric acid is added so as to adjust the pH to approximately 2. Methacryloxypropyltrimethoxysilane (MPTMS) is added to the dispersion liquid of core fine particle 1 at a mass ratio of 3/2 relative to the core fine particle 1, and then heated at 65° C. for 30 minutes.

A 10 mass % aqueous solution of potassium persulfate (KPS) is then added at a MPTMS/KPS ratio of 10/1, and heated at 80° C. for 3 hours. Composite particle 1 was then obtained by cooling and drying. The formulation and physical properties of composite particle 1 are shown in Table 3. As a result of observations using a transmission electron microscope (TEM), it was confirmed that composite particle 1 had a core/shell type structure in which an organosilicon polymer coating layer was formed on the surface of the organic substance fine particle.

Production Examples of Composite Particles 2 to 11

Composite particles 2 to 11 were obtained in the same way as in the production example of composite particle 1, except that the formulation and quantity of organic substance used in the core were altered. The formulations and physical properties are shown in Table 3. As a result of observations using a transmission electron microscope, it was confirmed that composite particles 2 to 11 had a core/shell type structure in which an organosilicon polymer coating layer was formed on the surface of the organic substance fine particle.

Moreover, confirmation of the coating layer was carried out in the manner described below.

Composite particles are dispersed in an ordinary temperature-curable epoxy resin and allowed to stand for 2 days in an atmosphere having a temperature of 40° C., and the epoxy resin is cured. Flaky samples are cut from the obtained cured product using a microtome equipped with a diamond blade. A cross section of the composite particle is observed by magnifying the sample 10,000 to 100,000 times using a transmission electron microscope (product name: Tecnai TF20XT, available from FEI Company, Inc.).

In the present invention, it is possible to see the difference between organosilicon polymer parts and organic substance parts by using the fact that the difference in the atomic weights of the atoms in the organic substance and organosilicon polymer leads to greater contrast for a higher atomic weight. Furthermore, a ruthenium tetroxide staining method and an osmium tetroxide staining method are used in order to increase contrast between materials. Using a vacuum electronic staining device (product name: VSC4R1H, available from Filgen, Inc.), a flaky sample is placed in a chamber and stained for 15 minutes at a density of 5.

In this way, a bright field image of the composite particle is obtained at an accelerating voltage of 200 kV using a transmission electron microscope (product name: Tecnai TF20XT, available from FEI Company, Inc.). Next, EF mapping images are acquired of the Si—K edge (99 eV) according to the three window method using an EELS detector (product name: GIF Tridiem available from Gatan, Inc.) so as to confirm the presence of the organosilicon polymer in the surface layer.

Production Example of Composite Particle 12

2 parts of a wax (C105 available from Sasol Limited) was frozen and crushed by means of liquid nitrogen using a Cryogenic Sample Crusher (Model JFC-300) available from Industry Co. Ltd. Fumed silica (BET: 200 $m^2/g$) was externally mixed at a quantity of 0.5 parts relative to 50 parts of the frozen and crushed wax using an FM mixer (available from Nippon Coke & Engineering Co., Ltd.), thereby causing the silica to adhere to the surface of the wax. Composite particle 12 was obtained by sieving through a mesh having an opening size of 30 μm. As a result of observations using a scanning electron microscope, it was confirmed that in composite particle 12, the fumed silica was adhered to the surface of the wax without being buried.

The formulation and physical properties of composite particle 12 are shown in Table 3.

Production Example of Composite Particle 13

5 parts of crystalline resin 1 and 10 parts of methyl ethyl ketone (MEK) were placed in a reaction vessel equipped with a stirrer, a condenser, a temperature gauge and a nitrogen inlet tube and dissolved by being heated to 50° C.

Next, 0.45 parts of triethylamine having a pKa value of 10.8 was added as a neutralizing agent under stirring. Once it had been confirmed that the resin had sufficiently dissolved, 75 parts of water was added dropwise at a rate of 2.5 g/min so as to achieve phase inversion emulsification, thereby obtaining crystalline resin fine particle dispersion liquid 1 (solid content concentration: 5.7 mass %).

The MEK was sufficiently distilled off at 60° C. using an evaporator. Here, crystalline resin fine particle dispersion liquid 1 had a pH of 9.0. The pH was measured while adding 0.1 N hydrochloric acid dropwise to crystalline resin fine particle dispersion liquid 1, and the pH was adjusted to 2.0.

15 parts of methacryloxypropyltrimethoxysilane (MPTMS) was added to 10 parts of crystalline resin fine particle dispersion liquid 1 and heated at 65° C. for 30 minutes. Next, a silicon polymer coating layer was produced by adding 1.5 parts of a 10 mass % aqueous solution of potassium persulfate (KPS) and heating at 80° C. for 3 hours so as to cause hydrolysis and polycondensation to progress. Composite particle 13 was then obtained by cooling and drying.

Physical properties of composite particle 13 are shown in Table 3. As a result of observations using a transmission electron microscope, it was confirmed that composite particle 13 had a core/shell type structure in which an organosilicon polymer coating layer was formed on the surface of the organic substance fine particle.

Production Example of Composite Particle 14

Composite particle 14 was obtained in the same way as composite particle 13, except that dimethylaminoethanol having a pKa value of 9.2 was used as the neutralizing agent and the pH was adjusted to 3.0 by means of hydrochloric acid.

Physical properties of composite particle 14 are shown in Table 3. As a result of observations using a transmission electron microscope, it was confirmed that composite particle 14 had a core/shell type structure in which an organosilicon polymer coating layer was formed on the surface of the organic substance fine particle.

Production Example of Composite Particle 15

Composite particle 15 was obtained in the same way as composite particle 13, except that butylamine having a pKa value of 12.5 was used as the neutralizing agent, 0.04 parts of sodium lauryl sulfate was added as a surfactant and the pH was adjusted to 5.5 by means of hydrochloric acid.

Physical properties of composite particle 15 are shown in Table 3. As a result of observations using a transmission electron microscope, it was confirmed that composite particle 15 had a core/shell type structure in which an organosilicon polymer coating layer was formed on the surface of the organic substance fine particle.

TABLE 3

| Composite particle No. | Inner organic substance | Proportion of inner organic substance mass % | Softening point of inner organic substance ° C. | Acid value mgKOH/g | Number average particle diameter of primary particles nm | Dv/Dn |
|---|---|---|---|---|---|---|
| 1 | Crystalline resin 1 | 41 | 62 | 19 | 100 | 2.1 |
| 2 | Crystalline resin 1 | 20 | 62 | 19 | 110 | 2.2 |
| 3 | Crystalline resin 2 | 38 | 90 | 14 | 105 | 2.4 |
| 4 | Crystalline resin 3 | 40 | 70 | 5 | 100 | 2.4 |
| 5 | Crystalline resin 4 | 42 | 63 | 8 | 110 | 2.5 |
| 6 | Crystalline resin 5 | 43 | 92 | 11 | 115 | 2.5 |
| 7 | Crystalline resin 6 | 41 | 76 | 12 | 110 | 2.6 |
| 8 | Fischer Tropsch wax (C105 Sasol Limited) | 40 | 105 | — | 100 | 3.2 |
| 9 | Amorphous resin 1 | 36 | 130 | 28 | 100 | 2.8 |
| 10 | Amorphous resin 2 | 41 | 93 | 5 | 100 | 2.9 |
| 11 | Styrene-acrylic resin (FS102 Nipponpaint Co., Ltd.) | 40 | 225 | — | 105 | 1.7 |
| 12 | Fischer Tropsch wax (C105 Sasol Limited) | 40 | 105 | — | 105 | 4.2 |
| 13 | Crystalline resin 1 | 41 | 62 | 10 | 120 | 1.6 |
| 14 | Crystalline resin 1 | 41 | 62 | 12 | 130 | 1.7 |
| 15 | Crystalline resin 1 | 41 | 62 | 11 | 180 | 1.8 |

Production Example of Magnetic Iron Oxide Particles

An aqueous solution containing ferrous hydroxide was prepared by mixing an aqueous solution of ferrous sulfate with a caustic soda solution at a quantity corresponding to 1.1 equivalents of iron element. The pH of the aqueous solution was adjusted to 8.0, and an oxidation reaction was carried out at 85° C. while blowing air, thereby producing a seed crystal-containing slurry liquid.

Next, an aqueous solution of ferrous sulfate was added to this slurry liquid at a quantity corresponding to 1.0 equivalents relative to the initial alkali quantity (the sodium component in the caustic soda), the slurry liquid was held at a pH of 12.8, and an oxidation reaction was carried out while blowing air, thereby obtaining a slurry liquid containing magnetic iron oxide. This slurry was filtered, washed, dried and pulverized so as to obtain magnetic iron oxide particles having a number average particle diameter of primary particles of 0.20 μm, an intensity of magnetization of 65.9 $Am^2/kg$ in a 79.6 kA/m magnetic field (1000 Oersteds), a residual magnetization of 7.3 $Am^2/kg$ and an octahedral structure.

Production Example of Toner Particle 1

Amorphous Polyester Resin A (50.0 parts by mole of an adduct of (2.2 moles of) propylene oxide to bisphenol A, 50.0 parts by mole of an adduct of (2.2 moles of) ethylene oxide to bisphenol A, 76.0 parts by mole of terephthalic acid and 4.0 parts by mole of trimellitic anhydride)

(Tg: 62° C., softening point Tm: 135° C.): 100 parts

Magnetic iron oxide particles: 75 parts

C105 (Available from Sasol Limited): 2 parts

T77 (available from Hodogaya Chemical Co., Ltd.): 2 parts

The materials listed above were premixed using an FM mixer (available from Nippon Coke & Engineering Co., Ltd.), and melt kneaded using a twin screw extruder (product name: PCM-30, available from Ikegai Ironworks Corp.) with the temperature set so that the temperature of the molten product at the discharge port was 150° C.

The obtained kneaded product was cooled, coarsely pulverized using a hammer mill, and then finely pulverized using a pulverizer (product name: Turbo Mill T250, available from Turbo Kogyo Co., Ltd.). The obtained finely pulverized powder was classified using a multiple section sorting apparatus using the Coanda effect, thereby obtaining toner particle 1, which had a weight average particle diameter (D4) of 7.2 μm. Toner particle 1 had a glass transition temperature Tg of 62° C. and a softening point Tm of 135° C.

Production Example of Toner Particle 2

Amorphous polyester resin A (Tg: 62° C., softening point Tm: 135° C.): 100 parts Magnetic iron oxide particles: 75 parts C105 (available from Sasol Limited): 2 parts T177 (available from Hodogaya Chemical Co., Ltd.): 2 parts Crystalline resin 1: 4 parts Toner particle 2 was obtained by altering the formulation used in the production example of toner particle 1 as shown above. Toner particle 2 had a glass transition temperature Tg of 58° C. and a softening point Tm of 120° C.

Production Example of Toner 1

Toner particle 1: 100 parts

Composite particle 1: 1 part

Hydrophobic silica fine powder: 1 part (Silica that has been surface treated with a dimethylsilicone oil, number average particle diameter of primary particles: 10 nm, BET specific surface area of base silica: 200 $m^2/g$)

Toner 1 was obtained by externally mixing the materials listed above using an FM mixer (available from Nippon Coke & Engineering Co., Ltd.). Physical properties of obtained toner 1 are shown in Table 5.

Production Examples of Toners 2 to 16 and Comparative Toners 1 to 5

Toners 2 to 16 and comparative toners 1 to 5 were obtained in the same way as in the production example of toner 1, except that the types of externally added material were altered in the manner shown in Table 4. Physical properties are shown in Table 5.

Moreover, crystalline resins 5 and 6 shown in Table 1 were frozen and pulverized and then used as external additives. The number average particle diameter of crystalline resins 5 and 6 was 100 nm.

TABLE 4

| Toner No. | Toner particle No. | Type and added quantity of external additive (parts by mass relative to 100 parts by mass of toner particle) | | | | Structure of organic substance-containing external additive |
|---|---|---|---|---|---|---|
| 1 | 1 | Composite particle 1 | 1.0 | Silica | 1.0 | Coating layer structure |
| 2 | 1 | Composite particle 1 | 10.0 | Silica | 1.0 | Coating layer structure |
| 3 | 1 | Composite particle 1 | 0.2 | Silica | 1.0 | Coating layer structure |
| 4 | 1 | Composite particle 2 | 1.0 | Silica | 1.0 | Coating layer structure |
| 5 | 1 | Composite particle 3 | 1.0 | Silica | 1.0 | Coating layer structure |
| 6 | 1 | Composite particle 4 | 1.0 | Silica | 1.0 | Coating layer structure |
| 7 | 1 | Composite particle 5 | 1.0 | Silica | 1.0 | Coating layer structure |
| 8 | 1 | Composite particle 6 | 1.0 | Silica | 1.0 | Coating layer structure |
| 9 | 1 | Composite particle 7 | 1.0 | Silica | 1.0 | Coating layer structure |
| 10 | 1 | Composite particle 8 | 1.0 | Silica | 1.0 | Coating layer structure |
| 11 | 1 | Composite particle 9 | 1.0 | Silica | 1.0 | Coating layer structure |
| 12 | 1 | Composite particle 10 | 1.0 | Silica | 1.0 | Coating layer structure |
| 13 | 2 | Composite particle 9 | 1.0 | Silica | 1.0 | Coating layer structure |
| 14 | 1 | Composite particle 13 | 1.0 | Silica | 1.0 | Coating layer structure |
| 15 | 1 | Composite particle 14 | 1.0 | Silica | 1.0 | Coating layer structure |
| 16 | 1 | Composite particle 15 | 1.0 | Silica | 1.0 | Coating layer structure |
| Comparative 1 | 1 | Composite particle 11 | 1.0 | Silica | 1.0 | Coating layer structure |
| Comparative 2 | 2 | Silica A | 1.0 | Silica | 1.0 | None |
| Comparative 3 | 1 | Composite particle 12 | 1.0 | Silica | 1.0 | Uneven structure |
| Comparative 4 | 1 | Crystalline resin 5 | 1.0 | Silica | 1.0 | Resin fine particle |
| Comparative 5 | 1 | Crystalline resin 6 | 1.0 | Silica | 1.0 | Resin fine particle |

In the Table 4, "Silica A" is a hydrophobic silica fine powder having large particle diameter (Number average particle diameter of primary particles: 100 nm), and "Silica" is a hydrophobic silica fine powder (Silica that has been surface treated with a dimethylsilicone oil, number average particle diameter of primary particles: 10 nm, BET specific surface area of base silica: 200 $m^2/g$).

TABLE 5

| Toner | Minimum value of (dE'/dT) on lowest temperature side [$\times 10^8$] | G' (Tmax) [$\times 10^8$] |
|---|---|---|
| Toner 1 | −2.46 | 4.04 |
| Toner 2 | −2.70 | 4.04 |
| Toner 3 | −2.02 | 4.22 |
| Toner 4 | −2.12 | 4.20 |
| Toner 5 | −1.90 | 4.82 |

TABLE 5-continued

| Toner | Minimum value of (dE'/dT) on lowest temperature side [$\times 10^8$] | G' (Tmax) [$\times 10^8$] |
|---|---|---|
| Toner 6 | −2.16 | 4.24 |
| Toner 7 | −2.36 | 3.53 |
| Toner 8 | −1.82 | 3.74 |
| Toner 9 | −2.02 | 3.82 |
| Toner 10 | −1.82 | 2.54 |
| Toner 11 | −1.35 | 2.56 |
| Toner 12 | −1.86 | 2.51 |
| Toner 13 | −1.88 | 2.20 |
| Toner 14 | −2.55 | 4.04 |
| Toner 15 | −2.51 | 4.04 |
| Toner 16 | −2.48 | 4.04 |
| Comparative toner 1 | −1.33 | 2.24 |
| Comparative toner 2 | −1.57 | 1.91 |
| Comparative toner 3 | −1.56 | 2.59 |
| Comparative toner 4 | −1.86 | 3.65 |
| Comparative toner 5 | −2.04 | 3.51 |

Example 1

The machine used to evaluate the present working example was a commercially available magnetic single component type printer HP LaserJet Enterprise M606dn (available from Hewlett Packard Enterprise Development LP, processing speed: 350 mm/sec), but modified to a processing speed of 400 mm/sec, and toner 1 was subjected to the evaluations described below using this machine. In addition, the evaluation paper was Vitality (available from Xerox Corporation, basis weight 75 $g/cm^2$, letter size). The evaluation results are shown in Table 6.

Examples 2 to 16

Evaluations were carried out in the same way as in example 1, except that toners 2 to 16 were used. The evaluation results are shown in Table 6.

Comparative Examples 1 to 5

Evaluations were carried out in the same way as in example 1, except that comparative toners 1 to 5 were used. The evaluation results are shown in Table 6.

Evaluation of Low Temperature Fixing Performance

Low temperature fixing performance was evaluated using an external fixing unit obtained by removing the fixing unit of the modified evaluation machine mentioned above, enabling the fixing unit to be set to an arbitrary temperature, and modifying so as to achieve a processing speed of 400 mm/sec. Using this apparatus, halftone images are outputted at image densities of from 0.60 to 0.65 by adjusting the temperature at 5° C. intervals within the range of from 170° C. to 220° C. An obtained image was rubbed back and forth five times using a carbon paper to which a load of 4.9 kPa was applied, and the rate of decrease in image density before and after the rubbing was measured.

Plots were made on a coordinate plane, with the horizontal axis being the preset temperature of the fixing unit and the vertical axis being the rate of decrease in image density, all the plots were joined using a straight line, the fixing onset temperature of the toner was deemed to be the fixing unit preset temperature at which the rate of decrease in image density was 10%, and low temperature fixing performance was evaluated according to the criteria listed below. A lower fixing onset temperature means better low temperature fixing performance. Low temperature fixing performance was evaluated in a low temperature low humidity environment (a temperature of 7.5° C. and a relative humidity of 15%), which are conditions that are unfavorable for thermally fixing a toner.

A: Fixing onset temperature is lower than 190° C.

B: Fixing onset temperature is not lower than 190° C. but lower than 200° C.

C: Fixing onset temperature is not lower than 200° C. but lower than 210° C.

D: Fixing onset temperature is not lower than 210° C.

Evaluation of Fixing Non-Uniformity

Fixing non-uniformity was evaluated using an external fixing unit obtained by removing the fixing unit of the modified evaluation machine mentioned above, enabling the fixing unit to be set to an arbitrary temperature, and modifying so as to achieve a processing speed of 400 mm/sec. Using this apparatus, halftone images are outputted at image densities of from 0.70 to 0.75. The preset temperature of the fixing unit was altered according to the toner being evaluated, and was set to be 10° C. higher than the temperature at which the rate of decrease in image density was 10% for the toner in question in the low temperature fixing performance evaluation above. It was assessed visually whether or not fixing non-uniformity occurred in the half tone images. The evaluation was carried out in a normal temperature normal humidity environment (at a temperature of 23° C. and a relative humidity of 60%).

A: No density non-uniformity.

B: Very slight density non-uniformity.

C: Some density non-uniformity, but not particularly noticeable.

D: Noticeable density non-uniformity throughout image.

Evaluation of Discharged Paper Adhesion Resistance

Discharged paper adhesion resistance was evaluated using the modified machine described above, but with the cooling fan inside the machine turned off.

A toner was charged in a prescribed process cartridge, a whole page solid image was printed on the front and a text image (the letter E, print percentage 5%) was printed on the rear of 100 sheets (200 pages) continuously in double-sided printing mode, and images were allowed to stack up in the delivery tray.

Following completion of printing, the prints were allowed to stand for 10 minutes, after which each of the 100 sheets was separated and inspected visually, the number of sheets (defective sheets) where toner had been removed and white was showing as a result of adhesion between the solid image (on the front) and the text image (on the rear) was counted, and discharged paper adhesion resistance was evaluated on the basis of this counted number. A smaller number means better discharged paper adhesion resistance. Evaluations were carried out at high temperature and high humidity (a temperature of 32.5° C. and a relative humidity of 85%), which are difficult conditions for discharged paper adhesion resistance.

A: 0 defective sheets.

B: From 1 to 5 defective sheets.

C: From 6 to 10 defective sheets.

D: 11 or more defective sheets.

Evaluation of Durable Developing Performance

A toner was charged in a prescribed process cartridge. With 1 job being 2 sheets of a horizontal line pattern having a print percentage of 2%, a test was carried out by printing a total of 12,000 sheets while temporarily stopping the machine between jobs. For the 10th sheet and the 12,000th sheet, a solid round image measuring 5 mm was printed instead of a horizontal line pattern, the image density of which was measured, and durable developing performance was evaluated on the basis of this difference in image density. Evaluations were carried out at high temperature and high humidity (a temperature of 32.5° C. and a relative humidity of 85%), which are difficult conditions for developing performance. Image density was measured by measuring the reflection density of the solid round image measuring 5 mm using an SPI filter with a Macbeth densitometer (available from Macbeth Corp.), which is a reflection densitometer. A lower numerical value is better.

A: (Difference in image density between 10th sheet and 12,000th sheet: less than 0.15)

B: (Difference in image density between 10th sheet and 12,000th sheet: not less than 0.15 but less than 0.25)

C: (Difference in image density between 10th sheet and 12,000th sheet: not less than 0.25 but less than 0.35)

D: (Difference in image density between 10th sheet and 12,000th sheet: not less than 0.35 but less than 0.45)

E: (Difference in image density between 10th sheet and 12,000th sheet: not less than 0.45)

TABLE 6

| Example No. | Toner No. | Low temperature fixing performance | Fixing non-uniformity | Discharged paper adhesion resistance (number of defective sheets) | Durable developing performance (density of 10th sheet/density of 12,000th sheet/difference) |
|---|---|---|---|---|---|
| 1 | 1 | A (184° C.) | A | A (0) | A (1.51/1.39/0.12) |
| 2 | 2 | A (178° C.) | A | A (0) | A (1.47/1.37/0.10) |
| 3 | 3 | A (188° C.) | A | A (0) | A (1.48/1.34/0.14) |
| 4 | 4 | A (186° C.) | A | A (0) | A (1.48/1.42/0.06) |
| 5 | 5 | B (196° C.) | A | A (0) | A (1.52/1.42/0.10) |

TABLE 6-continued

| Example No. | Toner No. | Low temperature fixing performance | Fixing non-uniformity | Discharged paper adhesion resistance (number of defective sheets) | Durable developing performance (density of 10th sheet/density of 12,000th sheet/difference) |
|---|---|---|---|---|---|
| 6 | 6 | A (188° C.) | A | A (0) | A (1.49/1.43/0.06) |
| 7 | 7 | A (185° C.) | B | A (0) | A (1.48/1.37/0.11) |
| 8 | 8 | B (198° C.) | B | A (0) | B (1.48/1.29/0.19) |
| 9 | 9 | A (189° C.) | B | A (0) | C (1.50/1.22/0.28) |
| 10 | 10 | B (196° C.) | B | B (2) | C (1.46/1.18/0.28) |
| 11 | 11 | C (206° C.) | B | B (3) | A (1.46/1.40/0.06) |
| 12 | 12 | B (197° C.) | B | B (4) | C (1.47/1.14/0.33) |
| 13 | 13 | B (194° C.) | C | C (8) | B (1.46/1.30/0.16) |
| 14 | 14 | A (180° C.) | A | A (0) | A (1.51/1.40/0.11) |
| 15 | 15 | A (182° C.) | A | A (0) | A (1.51/1.39/0.12) |
| 16 | 16 | A (184° C.) | A | A (0) | A (1.51/1.39/0.12) |
| Comparative 1 | Comparative 1 | D (213° C.) | C | B (2) | B (1.48/1.30/0.18) |
| Comparative 2 | Comparative 2 | C (203° C.) | D | D (16) | B (1.50/1.33/0.17) |
| Comparative 3 | Comparative 3 | C (204° C.) | B | C (7) | D (1.44/1.05/0.39) |
| Comparative 4 | Comparative 4 | B (196° C.) | B | D (12) | D (1.34/0.92/0.42) |
| Comparative 5 | Comparative 5 | A (189° C.) | B | D (14) | E (1.35/0.89/0.46) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-94209, filed May 10, 2017, and Japanese Patent Application No. 2018-82313, filed Apr. 23, 2018, which are hereby incorporated by reference herein in their entirety.

What is claimed is:

1. A toner comprising:

a toner particle containing a binder resin and a colorant; and an external additive, wherein the external additive is a core-shell type composite particle having:

a core containing a crystalline polyester resin; and an organosilicon polymer-containing coating layer on the surface of the core, a softening point of the toner particle is from 90° C. to 180° C., and a softening point (Tm) of the crystalline polyester resin is from 50° C. to 105° C.

2. The toner according to claim 1, wherein an acid value of the crystalline polyester resin is from 4 mg KOH/g to 20 mg KOH/g.

3. The toner according to claim 1, wherein the crystalline polyester resin has a urethane bond.

4. The toner according to claim 1, wherein a weight average molecular weight Mw of the crystalline polyester resin is 18,000 or more.

* * * * *